United States Patent [19]

Sasser, Jr.

[11] Patent Number: 4,601,469

[45] Date of Patent: Jul. 22, 1986

[54] BALANCE BOARD WITH ROLLER RETAINER PIN

[76] Inventor: Martin V. Sasser, Jr., 2975 Holly Dr., Tracy, Calif. 95376

[21] Appl. No.: 597,085

[22] Filed: Apr. 5, 1984

[51] Int. Cl.[4] ..... A63B 7/08; A63B 23/04

[52] U.S. Cl. ..... 272/146; 272/111

[58] Field of Search ..... 272/111, 146, 77, 96; D21/191, 224, 228, 192–194, 236; 446/153; 280/87.04 A, 28.5

[56] References Cited

U.S. PATENT DOCUMENTS

| | | | |
|---|---|---|---|
| D. 224,424 | 7/1972 | Schell | 280/87.04 A |
| 3,488,049 | 1/1970 | Sasser | 272/146 |
| 3,618,970 | 11/1971 | Friggard | 280/87.04 A |
| 3,630,540 | 12/1971 | Smith | 272/146 |
| 3,895,794 | 7/1975 | England | 272/146 |
| 4,225,145 | 9/1980 | Carr | 280/87.04 A |
| 4,337,963 | 7/1982 | Stevenson | 280/87.04 A |

FOREIGN PATENT DOCUMENTS

| | | | |
|---|---|---|---|
| 1419408 | 10/1965 | France | 272/111 |

*Primary Examiner*—Richard J. Apley
*Assistant Examiner*—S. R. Crow
*Attorney, Agent, or Firm*—Harvey B. Jacobson; Clarence A. O'Brien

[57] ABSTRACT

A balance board structure for recreation or exercising use comprises a roller-supported foot platform having the roller positively retained in a frame under the platform by a retention pin extending through the roller into guide channels formed in opposed longitudinal side members of the frame. In use, the roller is manipulated along the frame by a person standing on the foot platform and the pin prevents separation of the components, for example during transport, or when the user falls off of the foot platform.

11 Claims, 9 Drawing Figures

BALANCE BOARD WITH ROLLER RETAINER PIN

BACKGROUND OF THE INVENTION

This invention relates to a roller-supported balance board structure used for recreational and/or exercise purposes, and which is generally of the type disclosed in my earlier U.S. Pat. No. 3,488,049 issued Jan. 6, 1970.

Balance board structures of the type disclosed in my earlier patent comprise a generally planar foot platform having a pocket or the like in its undersurface which receives a roller that supports the platform on a support surface (such as a floor or a support board of similar form to the foot platform) the roller conforming in length to the width of the pocket but being free to roll along the pocket under the control of a person balancing on the foot platform. Skill is required in maintaining one's balance on the platform while manipulating the roller along the pocket, and accordingly the structure is useful in providing recreational activity and/or exercise.

In structures in accordance with the aforementioned patent, the roller is retained in the pocket solely by the conforming interfitting relationship of these components. The present invention, however, is directed toward improving thereon by providing more positive retention of the roller with respect to the foot platform, thereby, for example, facilitating transportion of the deviced and improving its safety.

STATEMENT OF PRIOR ART

The following U.S. patents disclose balance board structures and the like, but none of these discloses the concepts or structure of the present invention.

U.S. Pat. No. 2,764,411
U.S. Pat. No. 2,829,891
U.S. Pat. No. 3,604,726
U.S. Pat. No. 3,630,540
U.S. Pat. 3,895,794
U.S. Pat. No. Des. 237,813

SUMMARY OF THE INVENTION

In accordance with the present invention, a balance board structure comprising a roller-supported foot platform is provided with roller retention means which, at least in a preferred embodiment, comprises an elongate retention pin projecting from each end of the roller, for receipt in elongate guide and retaining channels or the like formed on a frame to be secured on the base of the foot platform whereby, in use, the pin positively retains the roller and foot platform in assembled relation. The pin may, for example, be of a resilient nature whereby it may be flexed and snapped into the retaining channels for assembly of the components, or alternatively an access opening may be formed in the frame structure for receipt and removal of the pin.

A foot platform for a structure in accordance with the invention may comprise a solid board or the like with the roller frame being secured thereunder. Alternatively, the platform may have a central opening receiving the roller with the pin being received in channels formed in the edges of the platform defining the opening, and with portions of the platform on opposite sides of the opening receiving the user's feet. It is also within the scope of the invention to provide a frame and roller assembly with a retention pin for securement to the base of a suitable foot platform such as a surfboard.

The foot platform further may be formed in alternative designs simulative, for example, of game ball or other sports items, food items or the like to enhance the attraction of the device, for example, or to assist in indicating its use as an exercise or training aid. The upper surface of the foot platform may carry advertising material, slogans, team logos, or the like.

A balance board structure in accordance with the invention overcomes problems associated with prior art designs such as, for example, separation and loss of the roller during shipment and storage, a tendency for the roller to separate from the foot platform during use, leading to accidents, and the necessity to reposition or adjust the roller each time the device is used.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
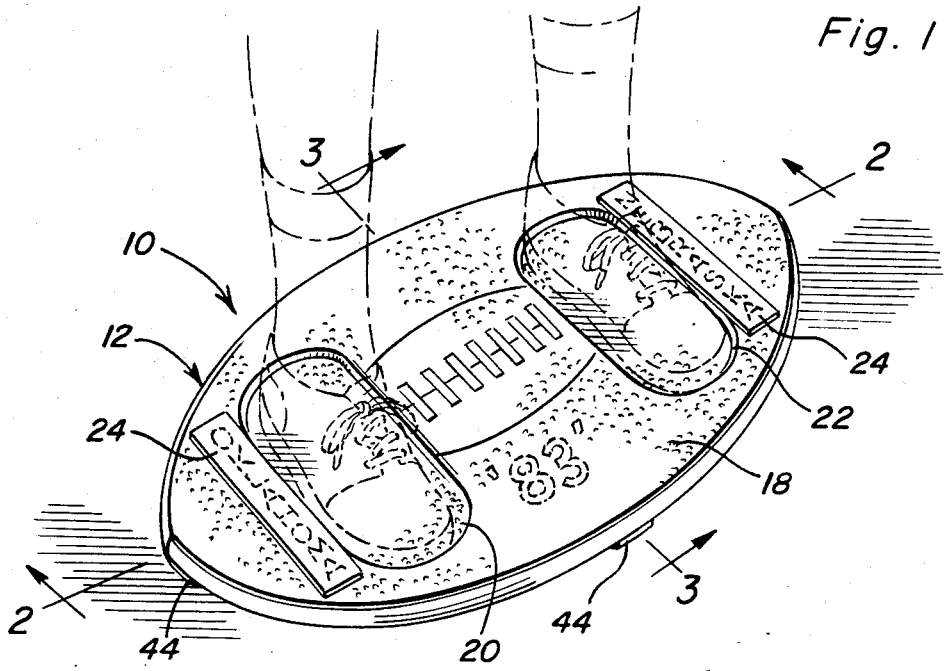
FIG. 1 is a perspective view of a first form of balance board structure in accordance with the invention.
Figure 2:
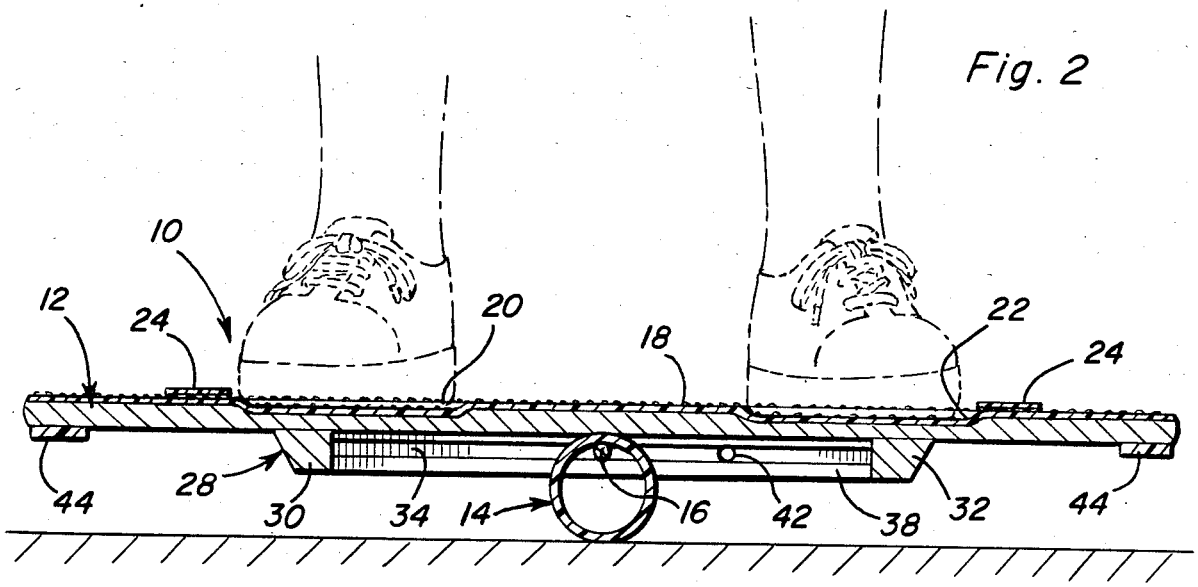
FIG. 2 is a cross-sectional view on line 2—2 of FIG. 1.

Referring initially to FIGS. 1 to 4, there is illustrated a balance board structure 10 comprising a foot platform 12 supported on a roller 14 which is releasably attached beneath the foot platform by means of a retainer pin 16 as will be described.

Foot platform 12 may be made of wood or a suitable plastic and, in the illustrated embodiment, is shaped to simulate a football. The upper surface of the foot platform may have a suitable non-slip covering 18 and recesses 20, 22 may be provided for a user's feet. The covering may also be provided with slogans or logos 24 or the like.

Roller 14 is supported below the foot platform in a roller pocket 26 defined by a rectangular frame 28 on the base of the foot platform. In the case of a plastic platform, the frame may be molded integrally therewith, or for other types of platform the frame may be attached to the undersurface thereof by any suitable attachment means known in the art. The length of the roller conforms substantially to the width of the pocket, and the roller is free to roll along the length of the pocket up to the respective end walls 30, 32 of the frame (see also FIG. 5).

Roller 14 may be of a hollow cylindrical form as shown, made in a material of sufficient strength to support a user, with pin 16 freely received therein. The respective ends of the pin are received in guide channels 34, 36 formed in respective side walls 38, 40 of frame 28, thereby retaining the roller and foot platform in assembled relation. When a user stands on the platform and manipulates the roller along the length of pocket 26, the pin ends move along the respective channels. Lubricant, as referred to in my earlier patent mentioned above, the disclosure of which is incorporated herein by reference, may be used between the pin and frame. A pin insertion and removal opening 42 is provided through side wall 38, and the opening may be plugged during use to prevent inadvertent removal of the pin.

The foot platform may be provided on its undersurface with resilient bumpers 44.

As previously noted, the pin maintains the roller and foot platform in assembled relation, obviating the need for adjustment or positioning of the roller when commencing use of the device, and preventing separation thereof during transportation, or in the event the user takes a fall.

Figure 5:
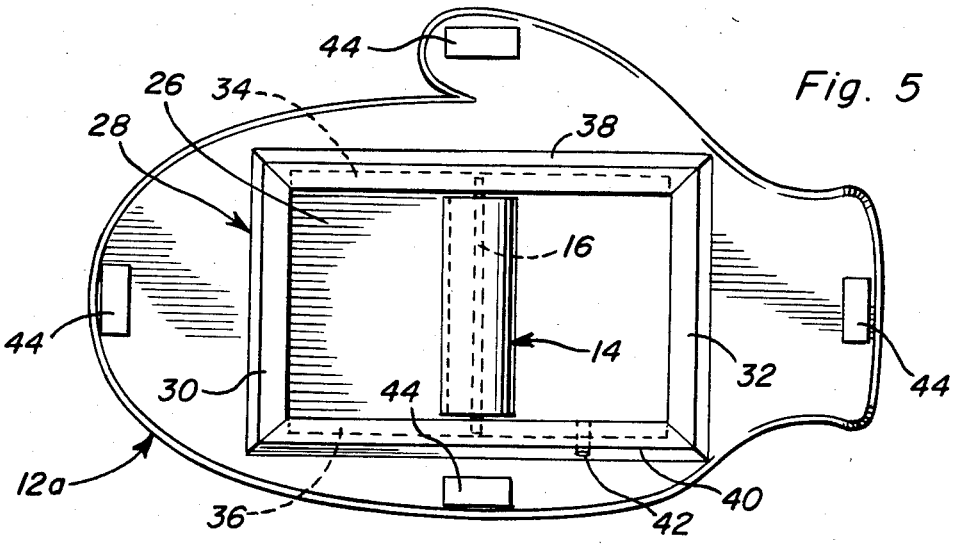
FIG. 5 is an underneath plan view of a modified form of balance board structure.
Figure 3:
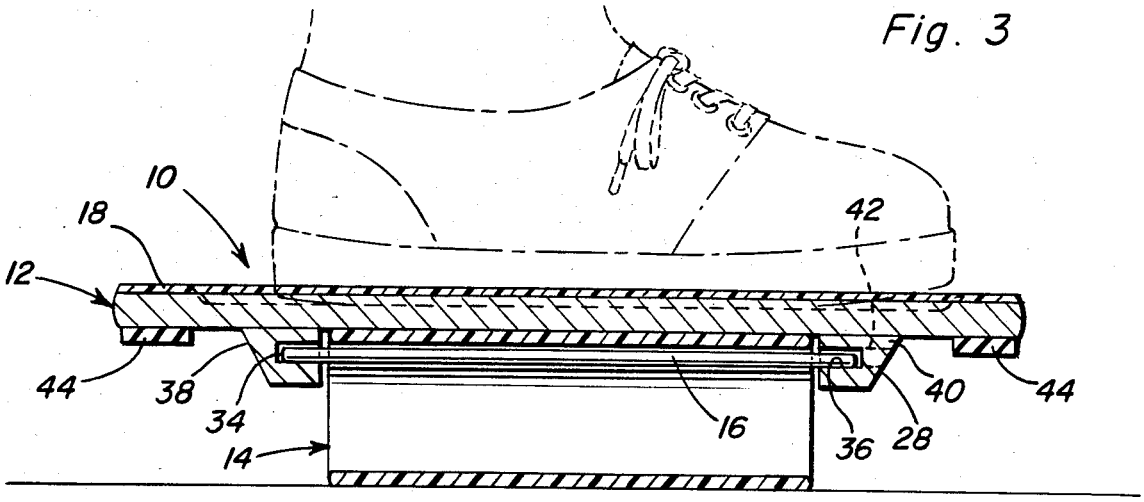
FIG. 3 is a cross-sectional view on line 3—3 of FIG. 1.
Figure 4:
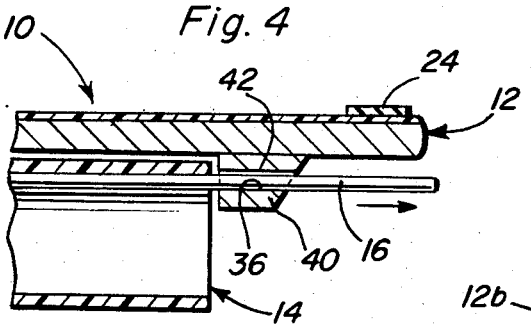
FIG. 4 is a view similar to FIG. 3 of only a front part of the structure showing the manner of removing the roller retainer pin.
Figure 6:
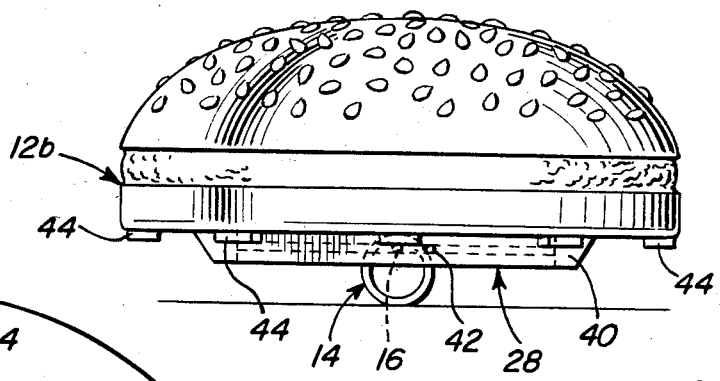
FIG. 6 is a front elevational view of another modified form of balance board structure.

The arrangement shown in FIG. 5 is similar to the construction previously described, except that the foot platform 12*a* in this case is shaped to simulate a boxing glove. In FIG. 6 the foot platform 12*b* is shaped to simulate a hamburger.

Figure 7:
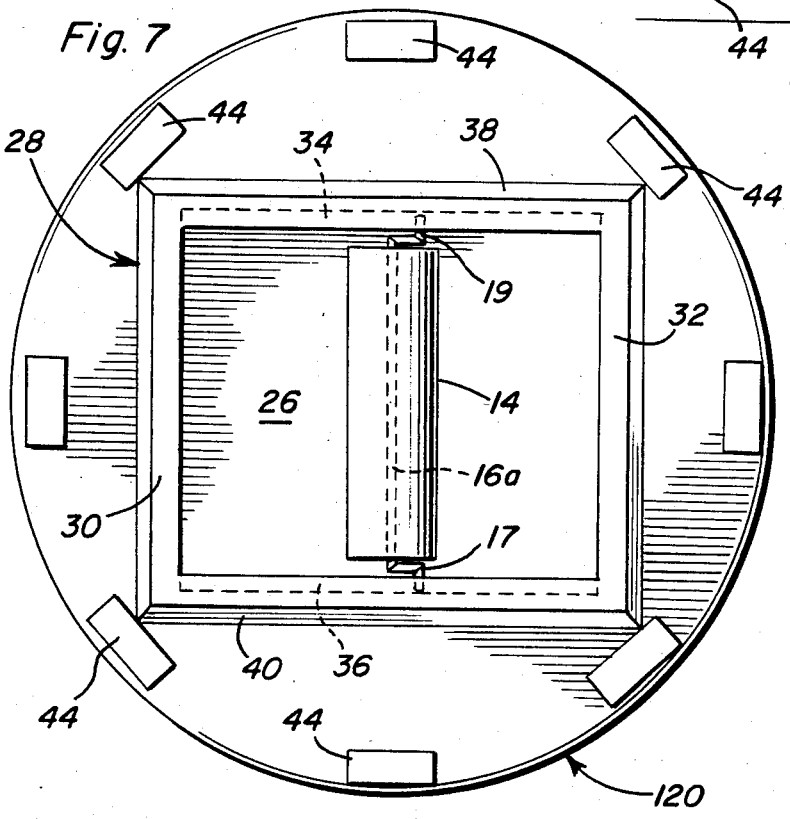
FIG. 7 is an underneath plan view of still another modified form of balance board structure.
Figure 8:
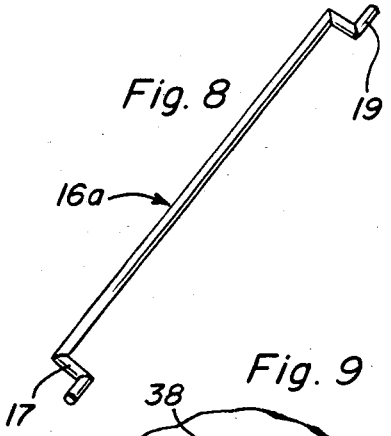
FIG. 8 is a perspective view of a roller retainer pin of the type used in the structure shown in FIG. 7.
Figure 9:
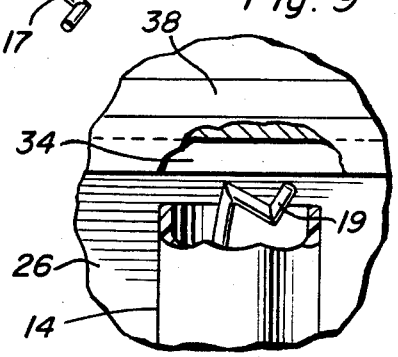
FIG. 9 is a part underneath plan view similar to FIG. 7 showing how the pin is inserted and removed.

In the embodiment illustrated in FIGS. 7 to 9, the foot platform 12*c* may be shaped and finished to simulate a soccer ball, basket ball, or the like, and pin 16*a* may be of a resilient spring-like material with cranked ends 17, 19, whereby the pin may be flexed as illustrated in FIG. 9, to snap the pin into, or remove it from the guide channels 34, 36, obviating the need for an opening corresponding to opening 42 in the previous embodiments. Operation of the structure is otherwise the same as in the previous embodiments.

In further modified forms of the invention (not illustrated) a frame-like assembly of the nature of frame 28, with an associated roller and pin, may be secured on the undersurface of articles such as surfboards and the like, to form a roller supported balance board, the securement, for example, being by suction pads, securing brackets, or the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A balance board structure comprising a foot platform, a tubular roller under the platform and roller retention means comprising an elongate pin extending loosely through the roller, the pin having opposite end portions extending from opposite ends of the roller, the opposite end portions of the pin being received in respective elongate guide channels formed on the foot platform.

2. The invention of claim 1 wherein the foot platform has a frame on an undersurface thereof defining a roller-receiving pocket, and wherein the guide channels are formed in opposed longitudinal side members of the frame.

3. The invention of claim 2 wherein one of said longitudinal side members of the frame includes a pin-insertion and removal opening formed therethrough.

4. The invention of claim 2 wherein the pin is of a resilient construction enabling flexing thereof for insertion and removal of the pin into and from said channels.

5. The invention of claim 4 wherein the pin has cranked ends.

6. The invention of claim 2 wherein the foot platform is molded in plastic and the frame is integrally molded therewith.

7. The invention of claim 1 wherein the foot platform is shaped to simulate a game-playing item such as a football, soccer ball, basketball and the like.

8. The invention of claim 1 wherein the foot platform is shaped to simulate a food item such as a hamburger, wiener and the like.

9. A frame assembly for the undersurface of a board and the like to form a roller-supported balance board structure, the frame assembly comprising side frame members end frame members defining a roller pocket, a hollow tubular roller received in the roller pocket, and a retention pin extending loosely through the roller, the pin having end portions extending from opposite ends of the roller, said portions being received in elongate guide channels formed in the side frame members for guiding the roller along said side frame members while retaining the roller in the pocket.

10. The invention of claim 9 wherein one of said side frame members includes an opening for insertion and removal of the pin.

11. The invention of claim 9 wherein the pin is of a resilient construction for flexing into and out of engagement with said channels.

* * * * *